US007251957B2

(12) United States Patent
Solomon

(10) Patent No.: US 7,251,957 B2
(45) Date of Patent: Aug. 7, 2007

(54) MUSICAL JEWELRY APPARATUS

(76) Inventor: Gary B. Solomon, 100 E. Huron St. #4803, Chicago, IL (US) 60611

( * ) Notice: Subject to any disclaimer, the term of this patent is extended or adjusted under 35 U.S.C. 154(b) by 30 days.

(21) Appl. No.: 11/004,506

(22) Filed: Dec. 3, 2004

(65) Prior Publication Data

US 2006/0117794 A1 Jun. 8, 2006

(51) Int. Cl.
*A44C 15/00* (2006.01)

(52) U.S. Cl. ..... 63/19

(58) Field of Classification Search ..... 63/19
See application file for complete search history.

(56) References Cited

U.S. PATENT DOCUMENTS

| | | | | |
|---|---|---|---|---|
| 2,807,118 A | | 9/1957 | Reuge | |
| 3,178,842 A | * | 4/1965 | Zimmerman | 40/661.06 |
| 3,798,806 A | | 3/1974 | Sanford | 40/28.1 |
| 4,101,955 A | | 7/1978 | DuNah | 362/104 |
| 4,124,022 A | | 11/1978 | Gross | 600/28 |
| 4,434,567 A | | 3/1984 | LeVeau | 40/717 |
| 4,604,606 A | | 8/1986 | Sweany | 340/384.6 |
| 4,810,997 A | | 3/1989 | Kudo et al. | 340/384.6 |
| 4,882,966 A | | 11/1989 | Silverman | 84/94.2 |
| 4,912,608 A | | 3/1990 | Lee | 362/104 |
| 4,947,722 A | | 8/1990 | Lewis | 84/95.2 |
| 4,973,941 A | | 11/1990 | Davis et al. | 340/384.7 |
| 5,056,660 A | | 10/1991 | Huang | 206/232 |
| 5,094,621 A | | 3/1992 | Friedel | 434/236 |
| 5,264,656 A | | 11/1993 | Itakura et al. | 84/600 |
| 5,345,153 A | | 9/1994 | Vaught | 318/4 |
| 5,586,452 A | | 12/1996 | Schmid | 63/19 |
| 5,957,747 A | * | 9/1999 | Liggitt | 446/297 |
| 6,097,281 A | | 8/2000 | Park | 340/384.7 |
| 6,262,352 B1 | | 7/2001 | Liu | 84/95.2 |
| 6,439,723 B1 | | 8/2002 | Tano | 353/15 |
| 6,538,186 B1 | | 3/2003 | Huang | 84/453 |
| 6,661,344 B2 | | 12/2003 | Bowling | 340/573.3 |
| 2004/0007119 A1 | | 1/2004 | Ra | 84/600 |

* cited by examiner

*Primary Examiner*—Jack W. Lavinder
(74) *Attorney, Agent, or Firm*—Neal, Gerber & Eisenberg LLP

(57) ABSTRACT

A musical jewelry apparatus is disclosed. The musical jewelry apparatus comprises a front member, a rear member, a hinge member, a musical and a power source. The hinge member is partially disposed on a portion of the front member and a portion of the rear member; and is adapted to hingedly connect the front member and the rear member. The musical member, which is powered by the power source, is disposed in either the front member or the rear member.

5 Claims, 5 Drawing Sheets

MUSICAL JEWELRY APPARATUS

FIELD OF THE INVENTION

The Present Invention is directed to jewelry and, in particular, to musical jewelry apparati having the ability to play a motion-activated musical tune.

BACKGROUND OF THE INVENTION

It has often been said regarding gifts that "it's the thought that counts." By this statement, it is meant that the more personal a gift is, the more rewarding it is, as such a gift acts as a constant reminder of the gift-giver.

One such gift is a photograph, or other item of a personal nature, that can be conveyed to a recipient. Such gifts, because they are not an attempt to buy affection—in addition to its obvious personal nature, immediately ascend to sentimental or heirloom status.

Currently, there are a number of devices which provide for donors to give loved recipients personal mementos. A locket is disclosed in U.S. Pat. No. 5,586,452, issued on 24 Dec. 1996 to Schmid. Schmid discloses an item of jewelry and, more specifically, lockets. See Schmid, Abstract.

However, although the invention disclosed in Schmid does allow for the placement of a photograph, other heirloom or keepsake memento therein, the invention does not provide for the ability to include a movement-activated musical device installed therein. Given the fact that music touches a sense different from the sight of the memento, coupling music to a personalized jewelry device, such as that disclosed in Schmid, can add even more sentimental value to such a gift.

Thus, the need exists for a musical jewelry apparatus that overcomes the above-stated disadvantages. Further, it should be noted that any description of any reference in this, or any other, Section is not intended to constitute an admission that the reference described herein is "Prior Art" with respect to the Present Invention, unless explicitly designated as such.

SUMMARY OF THE INVENTION

In accordance with the tenets and teachings of the Present Invention, a musical jewelry apparatus is disclosed. The musical jewelry apparatus comprises a front member, a rear member, a hinge member, a musical and a power source. The hinge member is partially disposed on a portion of the front member and a portion of the rear member; and is adapted to hingedly connect the front member and the rear member. The musical member, which is powered by the power source, is disposed in either the front member or the rear member.

A better understanding of the objects, advantages, features, properties and relationships of the Present Invention will be obtained from the following detailed description and accompanying drawings, which set forth illustrative embodiments, and are indicative of the various ways in which the principles, of the Present Invention may be employed.

BRIEF DESCRIPTION OF THE DRAWINGS

Other objects, features and advantages of the Present Invention will become more apparent from the following detailed description of the preferred embodiments and certain modifications thereof when taken together with the accompanying Figures, in which.

DETAILED DESCRIPTION OF THE PRESENTLY-PREFERRED EMBODIMENTS

Figure 1:
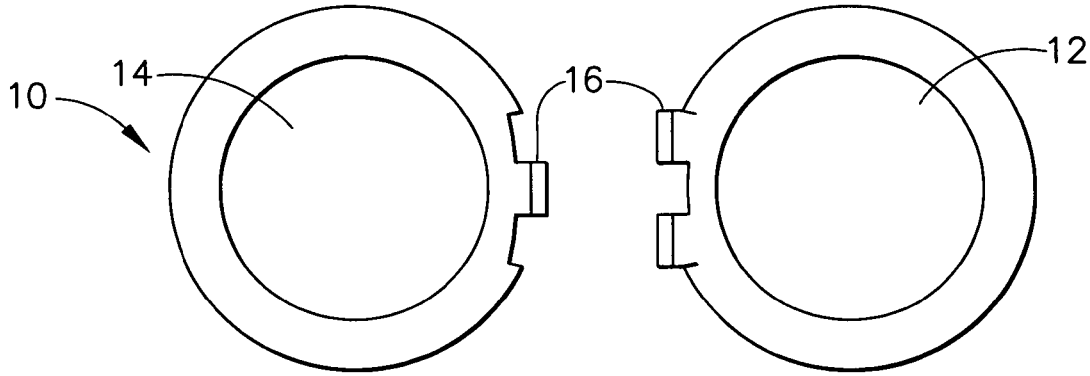
FIG. 1 illustrates a perspective view of one embodiment of a musical jewelry apparatus, made in accordance with the Present Invention.

The Present Invention relates to jewelry. In particular, the Present Invention relates to items of jewelry comprising two separate members connected at one end by a hinge, forming an ornamental case, which is preferably worn as a pendant on a necklace. Such a device is more commonly known as a locket.

The locket of the Present Invention, like most currently-known lockets, allows for the placement of at least one memento piece therein. Examples of memento pieces which can be placed inside the Present Invention include photographs, personal items, locks of hair, perfume, various and personal good luck items, monetary notes, etc. For purposes of the Present Invention, when in use, the term "memento" shall mean any type of keepsake which can be contained within an item of jewelry.

As mentioned above, lockets are preferably worn as a pendant on a necklace. However, the tenets and teachings of the Present Invention described herein should not be construed as limiting the lockets to such applications. For example, the Present Invention may be applicable to other items of jewelry capable of incorporating movement-actuated music, as described below. Examples of such items of jewelry can include, for example, watches having a closed face, rings allowing for the placement of a memento inside, etc.

Turning now to the Figures, in which like reference numerals refer to like elements, various embodiments of a musical jewelry apparatus, made in accordance with the teachings of the Present Invention described herein, are illustrated.

Figure 3:
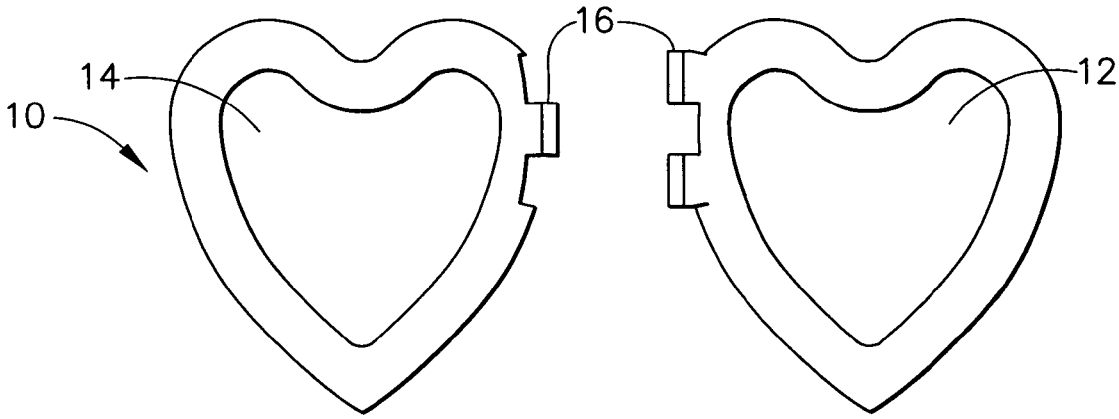
FIG. 3 illustrates a perspective view of another embodiment of a musical jewelry apparatus, made in accordance with the Present Invention.
Figure 4:
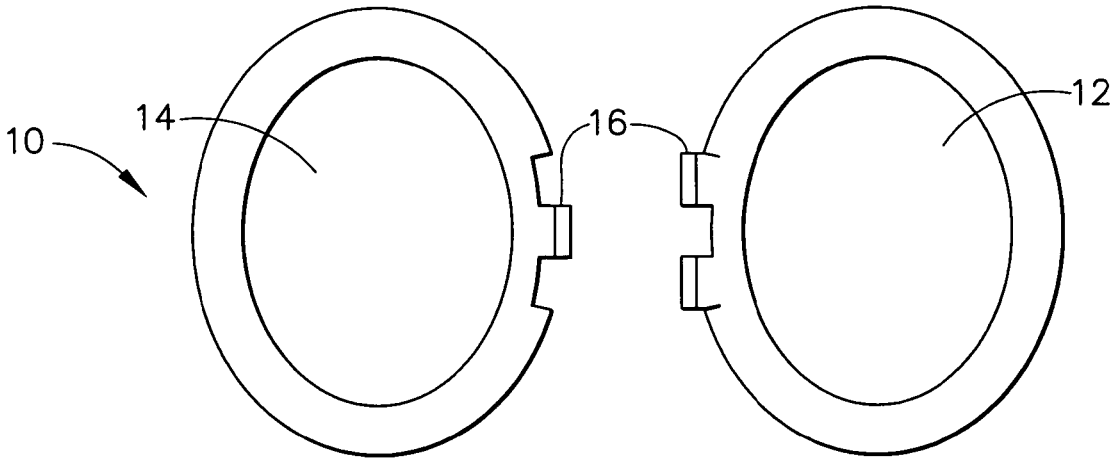
FIG. 4 illustrates a perspective view of another embodiment of a musical jewelry apparatus, made in accordance with the Present Invention.
Figure 2:
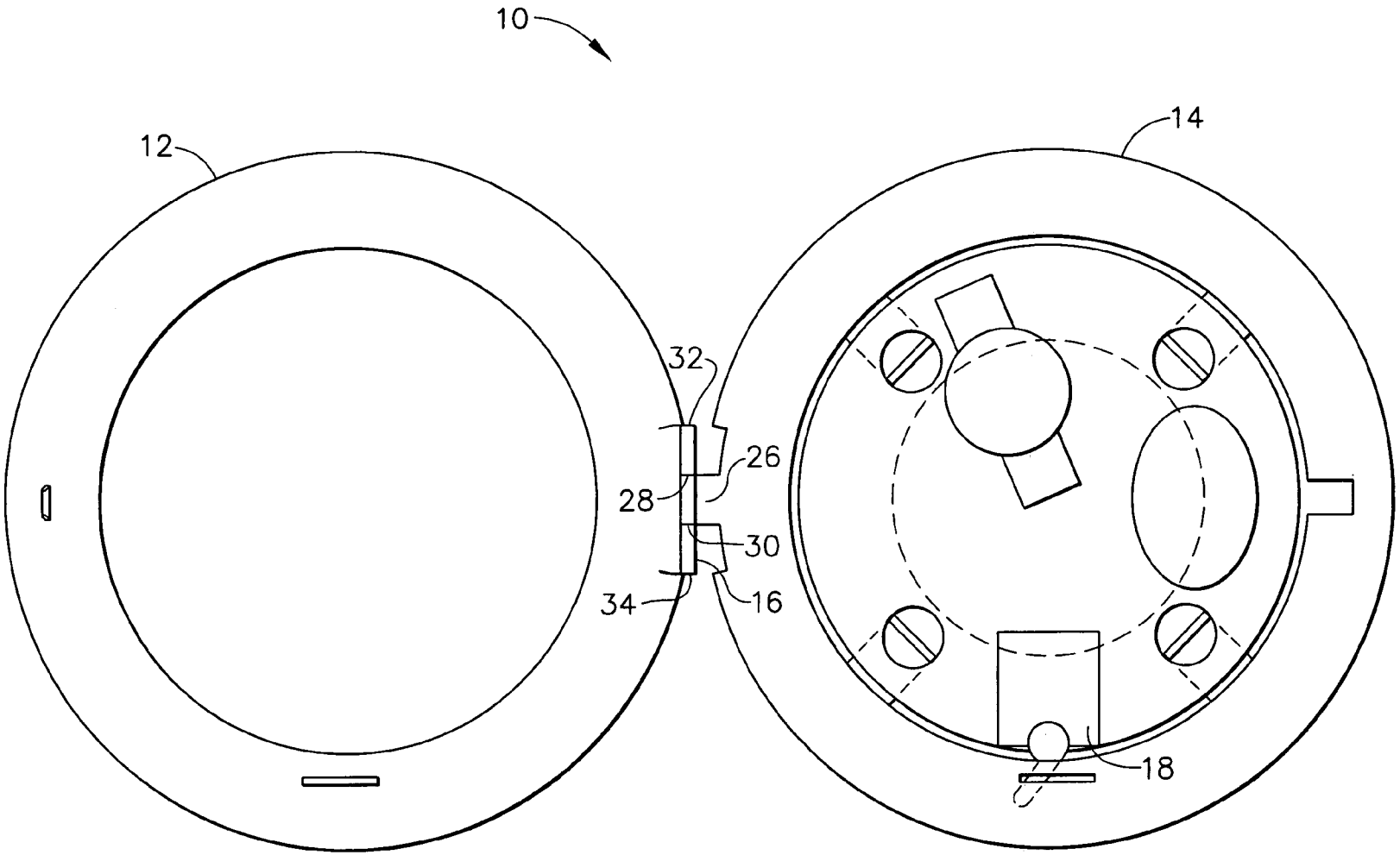
FIG. 2 illustrates a detailed perspective view of the musical jewelry apparatus of FIG. 1.

FIG. 1 illustrates a top-level figure of musical jewelry apparatus 10, while FIG. 2 illustrates a more detailed top-level figure of musical jewelry apparatus 10. Generally speaking, referring to FIGS. 1-2, musical jewelry apparatus 10 comprises front member 12, rear member 14, hinge portion 16 and musical portion 18. It is contemplated that musical jewelry apparatus 10 may comprise any size. Further, it is contemplated that musical jewelry apparatus 10 may take any two-dimensional shape (i.e., length and height). Although in FIG. 1 musical jewelry apparatus 10 is illustrated as being of a substantially circular shape, alternative embodiments are illustrated in FIGS. 3-4, which show alternative embodiments of musical jewelry apparatus 10 as heart-shaped and elliptically-shaped embodiments, respectively. Further, the outside portions of both front member 12 and rear member 14—that is, the portions that do not face each other—may be decorated in any preferred aesthetic manner. The third dimension of musical jewelry apparatus 10, (i.e., width), is preferably substantially elliptical. This is so that both any memento piece and musical portion 18 may be comfortably disposed therein (as will be described in greater detail below).

Front member 12 preferably comprises what will also be referred to herein, for clarity, the top portion of musical jewelry apparatus 10. Conversely, rear member 14 comprises the bottom portion of musical jewelry apparatus 10. Collectively, both front member 12 and rear member 14 are preferably similarly shaped objects, and each comprise substantially half of the structure of musical jewelry apparatus 10. That is, front member 12 and rear member 14 both comprise substantially elliptical or arcuately-shaped shells that, when placed in interlocking relationship with each other, form an open "pocket," in which the memento piece (s) (as well as musical member 18) may be placed.

Preferably, both front member 12 and rear member 14 of musical jewelry apparatus 10 are made of, for example, any standard or currently known type of lightweight metal, including, for example, base metal, silver, gold or platinum.

Figure 5:
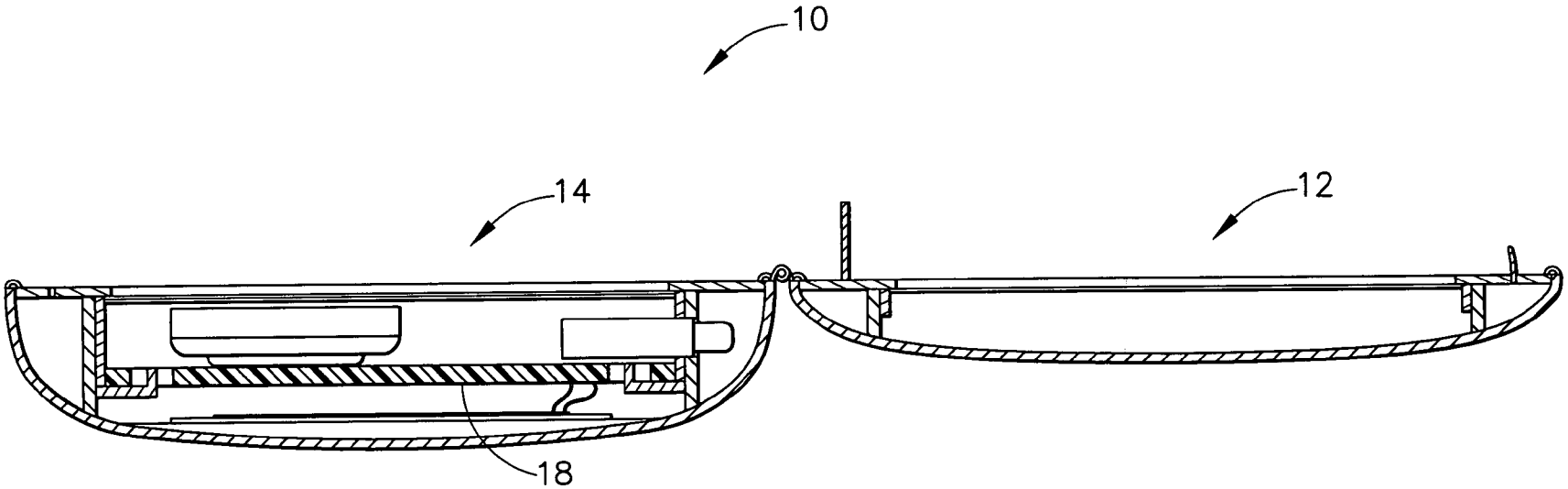
FIG. 5 illustrates a cutout view of the musical jewelry apparatus of FIG. 1.

As illustrated in FIG. 5, front member 12 preferably comprises a depth less than that of rear member 14. This is to compensate for the fact that musical member 18 and any desired memento piece are generally placed within rear member 14. However, it is nevertheless contemplated that front member 12 and rear member 14 may comprise equal depths, or that the depth of front member 12 may be greater than that of rear member 14.

Figure 6:
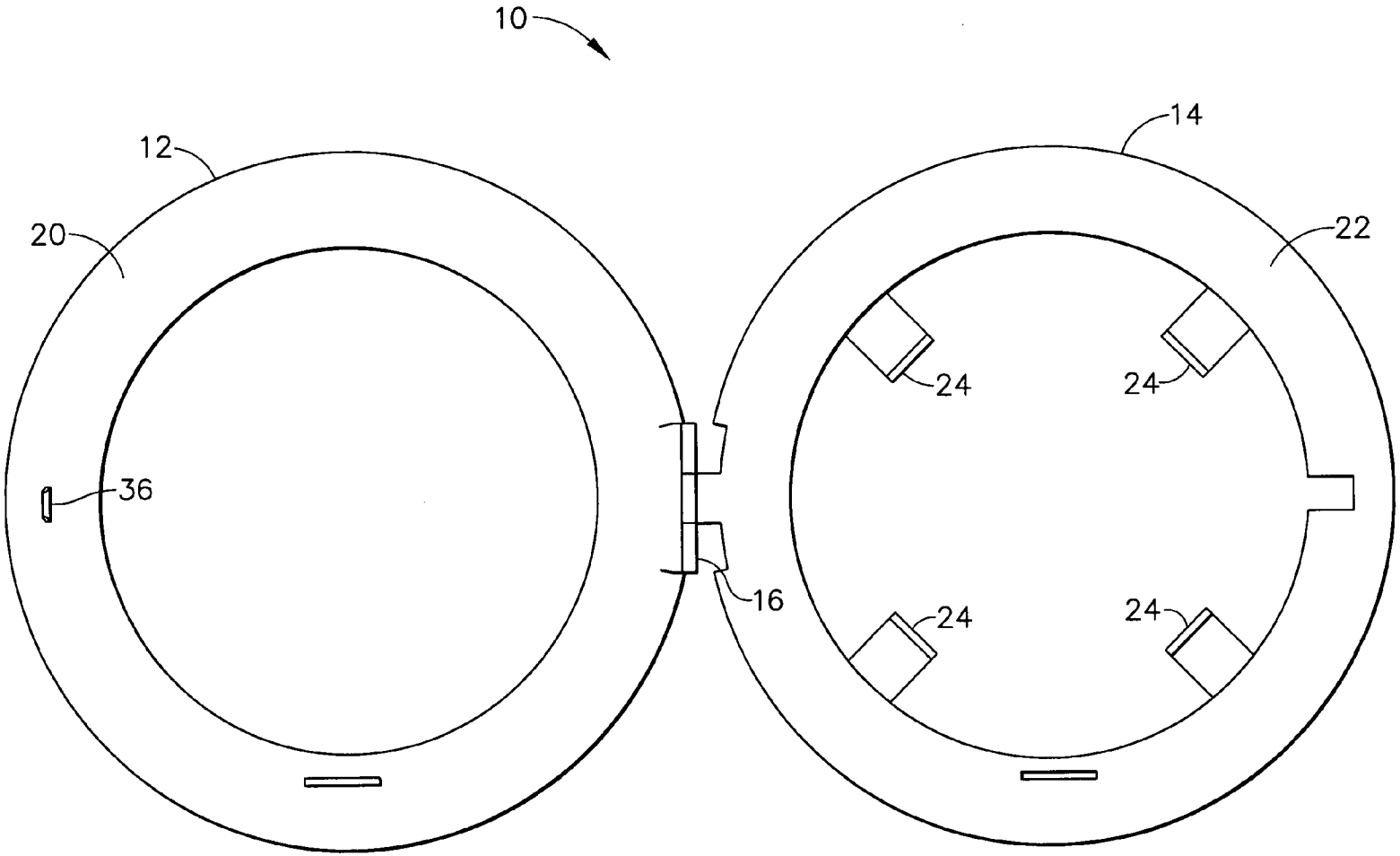
FIG. 6 illustrates a close up view of the front and rear members of the musical jewelry apparatus of FIG. 1.

As is illustrated by FIG. 6, for structural reasons, front member 12 is preferably provided with front member lip 20. Conversely, rear member 14 is provided with rear member lip 22. Front member lip 22, which acts as a rim on the inner side of front member 12, may be used to secure a memento piece within front member 12. Likewise, rear member lip 22 is intended to do the same for rear member 14. Also included within rear member lip 22 and illustrated in FIG. 6 are offsets 24. Offsets 24, which, like lips 20, 22, can be ornamental in design, are used to further secure musical member 18 within rear member 14, as well as to assist in securing memento piece within rear member 14. As with front member 12 and rear member 14, both front member lip 20, rear member lip 22 and offsets 24 can be made of, for example, any standard or currently known type of lightweight metal, including base metal, silver, gold or platinum.

To establish and maintain the interconnection between front member 12 and rear member 14, hinge member 16 is disclosed. Preferably, hinge member 16 comprises any known hinge (or similar device) that provides for the interconnection and hinged relationship between front member 12 and rear member 14. Hinge member 16 allows front member 12 to be placed in either an opened position or a closed position, vis-à-vis rear member 14. Hinge member 16 may also be configured to bias front member 12 in either opened or closed positions.

As can be seen clearly from FIG. 2, and, to a lesser extent, FIGS. 1 and 3-4, hinge member 16 preferably comprises tab portion 26, which is illustrated as extending from rear member 14. Preferably, tab portion 26 is shaped in such a manner as to end in a loop. That is, the end part of tab portion 26 is intended to be turned or shaped such that it comes back onto itself. The purpose for this is described below. It is not necessary that tab portion 26 extend from rear member 14; it may alternatively extend from front member 12. When connected, tab portion 26 preferably fits within reception portion 28, which is illustrated as disposed within front member 12. Similar to tab portion 26, reception portion 28 is also shaped in such a manner so as to end in a loop. Conversely, it is not necessary that reception portion 28 be disposed in front member 12; it may alternatively be disposed in rear member 14.

To ensure the interconnection of tab portion 26 with reception portion 28, each of the loops of tab portion 26 and reception portion 28 define an opening 30, 32, respectively, therein. Securing rod 34 is then inserted in the opening, ensuring that front member 12 and rear member 14 are interconnected. Alternatively, it is contemplated that hinge member 16 may comprise any other means and mechanism by which front member 12 can be interconnected to rear member 14.

In conjunction with hinge member 16, musical jewelry apparatus 10 may further comprise latch member 36. Latch member 36 preferably acts as a means to secure front member 12 and rear member 14 of musical jewelry apparatus 10 in a closed relationship.

Figure 7:
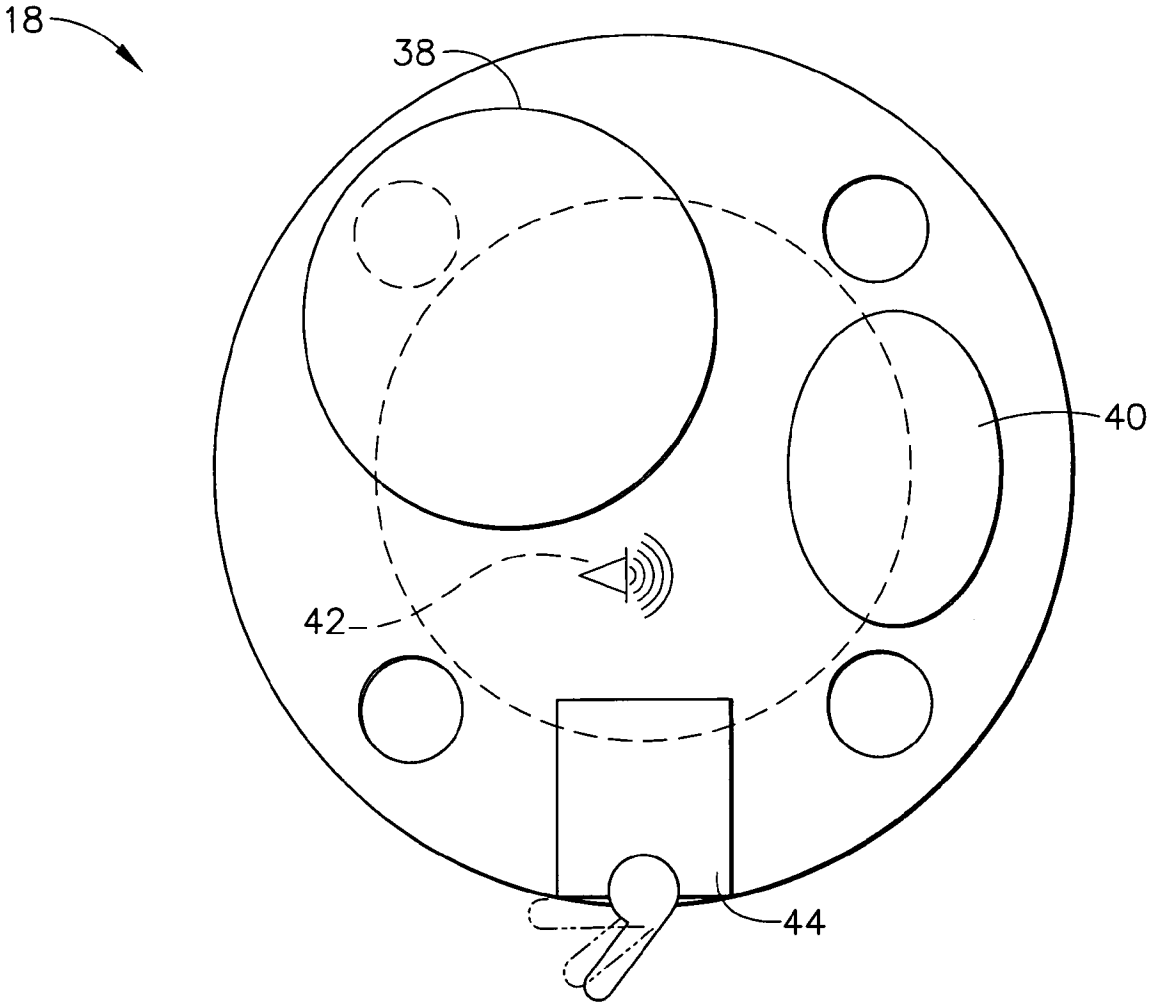
FIG. 7 illustrates a top level diagram of the musical member of the musical jewelry apparatus of FIG. 1.

Providing a musical aspect to musical jewelry apparatus 10 is musical portion 18. Musical portion 18 comprises any currently-known system which possesses the ability to play a musical piece. Preferably, and as illustrated in FIG. 7, musical portion 18 comprises battery 38, controller 40, output device 42 and switch 44. In operation, the various elements of musical member 18 combine to provide an electric circuit (a "musical circuit") for the playing of a musical tune.

Battery 38 preferably comprises any direct current battery currently known in the art. For purposes of the Present Invention, it is preferable that battery 38, in addition to all of musical member 18, be sized to fit wholly within rear member 14 (or, alternatively, front member 12). It is also preferable that battery 38 should be disposed within rear member 14 (or, alternatively, front member 12) of musical jewelry apparatus 10 in such a manner as to be easily accessible. The purpose for this is to permit the consumer to replace battery 38. Alternatively, musical jewelry apparatus 10 may be designed such that battery 30 is irreplaceable.

Controller 40 preferably comprises any currently known processor which controls the playing of a musical tune upon the opening of musical jewelry apparatus 10. Preferably, controller 40 contains a memory location, which at least one tune, which is played when the musical circuit is completed. Although it is preferred that controller 40 contains only one music tune, controller 40, alternatively can be configured to contain more than one tune. In such cases, it is also contemplated that the consumer/purchaser of musical jewelry apparatus 10 can select the musical tune to be played.

Output device 42 preferably comprises a speaker, or other similar device, through which the tune is played and heard by the consumer/purchaser, as well as by any member of the public.

Switch 44 provides the means by which musical member 18 is activated. More specifically, switch 44 is preferably configured to be in the circuit illustrated in FIG. 6 as being diagnosed in series with battery 38, controller 40 and output device 42. Further, switch 44 is configured to be active when hinge member 16 is in a position indicating that front member 12 is in an opened position, switch 44 completes the circuit between battery 38, controller 40 and output device 42, resulting in the playing of a musical tune. Alternatively, switch 44 can be configured to provide for a manual activation switch to the user of musical jewelry apparatus 10. In such a case, switch 44 can be activated when front member 12 is in the closed position.

While specific embodiments of the Present Invention have been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the Present Invention which is to be given the full breadth of the appended Claims and any equivalents thereof.

What is claimed is:

1. A musical jewelry apparatus, comprising:

a front member having an open position and a closed position;

a rear member;

a hinge member, the hinge member partially disposed on a portion of the front member and partially disposed on a portion of the rear member, the hinge member adapted to hingedly connect the front member with the rear member;

a musical member for playing a tune, the musical member disposed in one of the front member or the rear member and comprising a processor with a memory location, the memory location having at least one tune;

a first switch disposed on the musical jewelry apparatus, wherein the switch is operatively connected to the musical member and disposed on the musical jewelry apparatus such that the first switch will activate the musical member either automatically or when actuated by the user, wherein the first switch will activate the musical member automatically when the front member is in the open position, and wherein the first switch will activate the musical member when actuated by the user when the front member is in the closed position; and a power source for operating the musical member, wherein the power source is disposed wholly within one of the front member or the rear member.

2. The musical jewelry apparatus of claim 1, wherein the front member is biased in the open position.

3. The musical jewelry apparatus of claim 1, wherein the rear member is adapted to display a memento piece.

4. The musical jewelry apparatus of claim 3, wherein the memento piece is secured within the rear member.

5. The musical jewelry apparatus of claim 1, further comprising a second switch, wherein the first switch activates the musical member when the front member is in the open position and the second switch activates the musical member when the second switch is actuated by the user.

* * * * *